US005885189A

United States Patent [19]

Lane et al.

[11] Patent Number: 5,885,189

[45] Date of Patent: Mar. 23, 1999

[54] BALANCE BEAM

[75] Inventors: Mark R. Lane, Jefferson; Neal C. Squibb, Scranton, both of Iowa

[73] Assignee: American Sports International, Ltd., Jefferson, Iowa

[21] Appl. No.: 961,479

[22] Filed: Oct. 31, 1997

[51] Int. Cl.[6] ..... A63B 1/00

[52] U.S. Cl. ..... 482/38; 482/34; 248/560

[58] Field of Search ..... 482/38, 39, 41, 482/34, 35, 36, 23; 108/117, 118, 116; 248/560

[56] References Cited

U.S. PATENT DOCUMENTS 3,990,697 11/1976 Reuther .

*Primary Examiner*—Richard J. Apley
*Assistant Examiner*—Justine R. Yu
*Attorney, Agent, or Firm*—Zarley, McKee, Thomte, Voorhees & Sease

[57] ABSTRACT

A balance beam has an elongated beam member having opposite ends, a center portion, a top and a bottom, with legs on the bottom thereof adjacent the ends. Each leg has an upper and a lower end. A resilient support assembly is mounted within the elongated beam adjacent the ends thereof with each support assembly having a depending clevis extending downwardly therefrom with each clevis being pivotally secured to one of the upper ends of the legs. The legs extend downwardly and outwardly from the support assembly in the plane of the beam member so that the lower ends thereof dwell substantially under the ends of the beam member. Elongated links are pivotally secured by their ends to one end of the beam and one end of each of the legs to hold the beam member in an erected elevated horizontal position. Each leg has an upper portion that extends downwardly and outwardly from the clevis, and a lower portion that extends downwardly and outwardly from the upper portion, with the upper and lower portions having center axes forming an obtuse angle with respect to each other. The resilient support assembly is positioned within the beam and has two end blocks rigidly secured to the beam. An intermediate block is slidably mounted between the end blocks and is associated with the clevis. The resilient element is located between the intermediate block and the end block nearest the center portion of the beam member so that when a vertical force is applied downwardly on the top of the beam, the resilient element will yieldingly resist the sliding of the intermediate block towards the center portion. The legs on the beam are vertically adjustable and have an assist spring interposed between telescoping portions of the legs to assist the lifting of the beam during the height adjustment process.

9 Claims, 4 Drawing Sheets

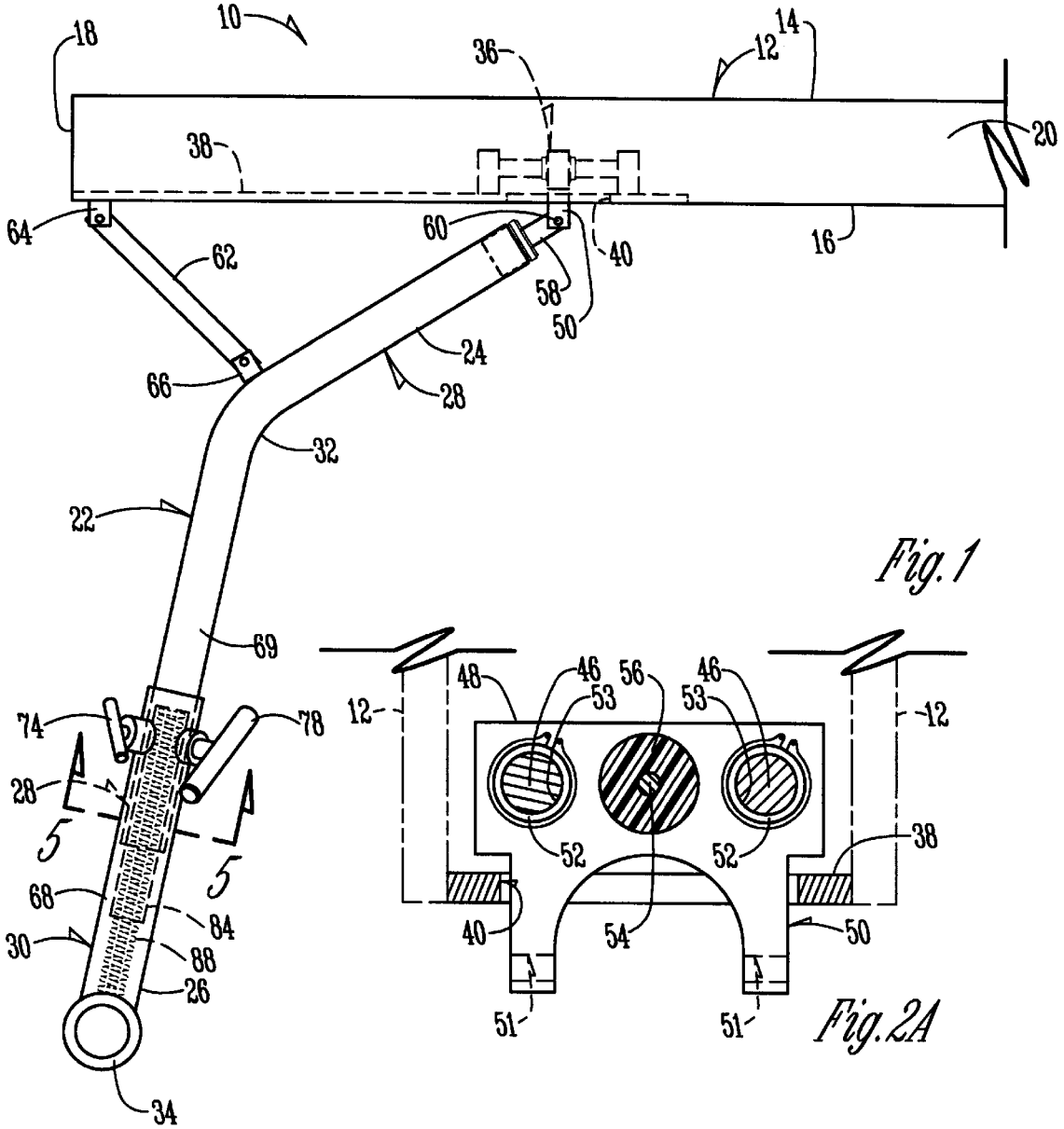
Fig. 1
Fig. 2A
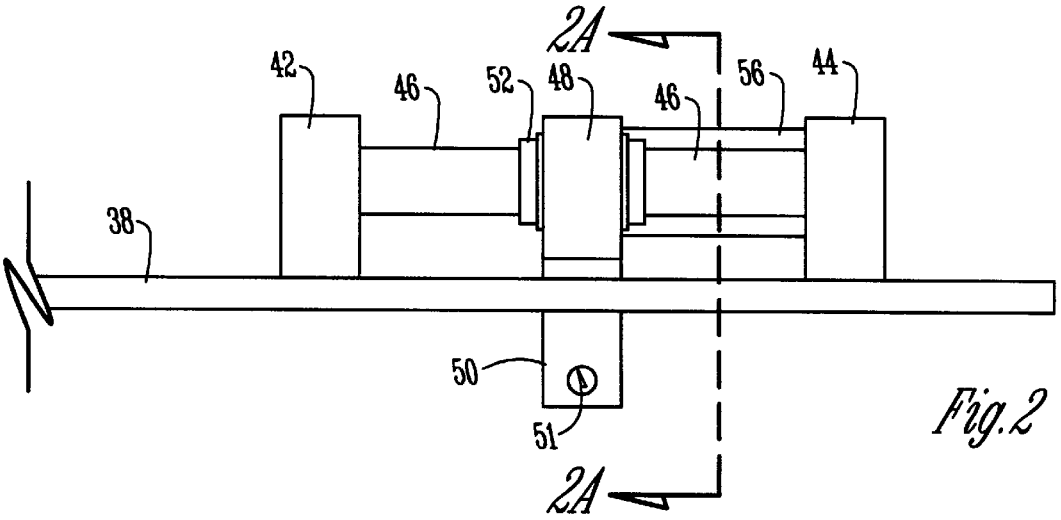
Fig. 2

BALANCE BEAM

BACKGROUND OF THE INVENTION

The balance beam has long been a poplar piece of gymnastics equipment. Efforts have been made to provide balance beams with some reflex action to absorb the impact of gymnasts performing thereon. However, such beams do not stay constant at any height adjustment, and get more flexible at lower heights.

Further, existing balance beams sometimes cause the legs of the beam to be extended so far that they require different floor mats for certain height adjustments of the legs. In addition, existing balance beams often are complex in assembly.

It is therefore a principal object of this invention to provide a balance beam that can be easily adjusted in height from 100 CM to 125 CM in 5 CM increments.

A further object of this invention is to provide a reflex action utilizing a urethane spring wherein various durometer values can be used to create different degrees of balance.

A still further object of this invention is to provide a balance beam that is very quiet in operation and stable in its reflex action.

A further object of this invention is to provide a balance beam whose height can be easily and quickly adjusted.

These and other objects will be apparent to those skilled in the art.

SUMMARY OF THE INVENTION

The balance beam of this invention has an elongated beam member having opposite ends, a center portion, a top and a bottom, with legs on the bottom thereof adjacent the ends.

Each leg has an upper and a lower end. A resilient support assembly is mounted within the elongated beam adjacent the ends thereof with each support assembly having a depending clevis extending downwardly therefrom with each clevis being pivotally secured to one of the upper ends of the legs. The legs extend downwardly and outwardly from the support assembly in the plane of the beam member so that the lower ends thereof dwell substantially under the ends of the beam member. Elongated links are pivotally secured by their ends to one end of the beam and one end of each of the legs to hold the beam member in an erected elevated horizontal position.

Each leg has an upper portion that extends downwardly and outwardly from the clevis, and a lower portion that extends downwardly and outwardly from the upper portion, with the upper and lower portions having center axes forming an obtuse angle with respect to each other. The resilient support assembly is positioned within the beam and has two end blocks rigidly secured to the beam. An intermediate block is slidably mounted between the end blocks and is associated with the clevis. The resilient element is located between the intermediate block and the end block nearest the center portion of the beam member so that when a vertical force is applied downwardly on the top of the beam, the resilient element will yieldingly resist the sliding of the intermediate block towards the center portion.

The legs on the beam are vertically adjustable and have an assist spring interposed between telescoping portions of the legs to assist the lifting of the beam during the height adjustment process.

BRIEF DESCRIPTION OF THE DRAWINGS

FIG. 1 is a side elevational view of one end of the balance beam of this invention;

FIG. 2 is an enlarged scale side elevational view of the support assembly shown in dotted lines in FIG. 1;

FIG. 2A is a sectional view taken on line 2A—2A of FIG. 2;

DESCRIPTION OF THE PREFERRED EMBODIMENT

Figure 3:
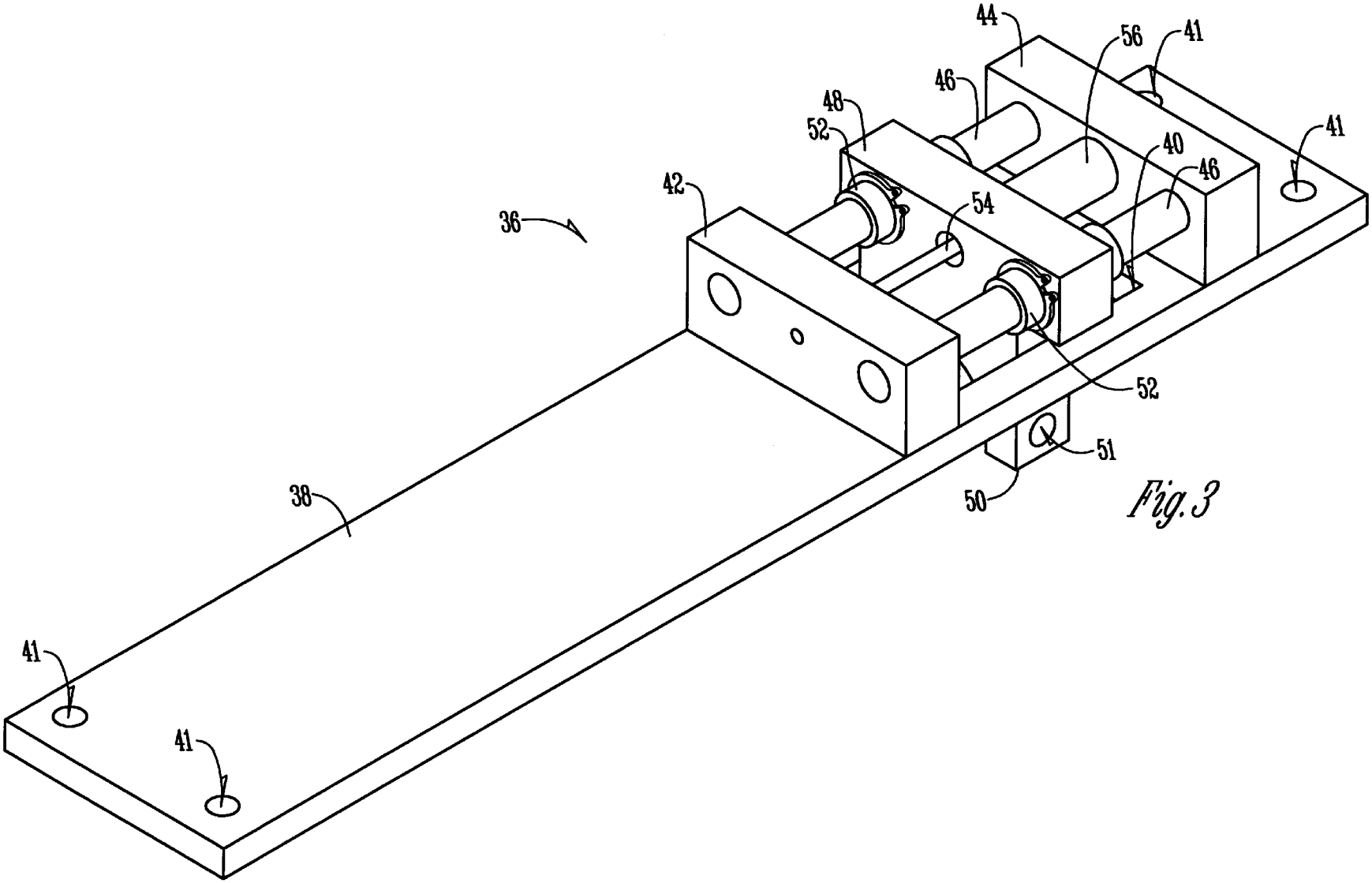
FIG. 3 is an enlarged scale perspective view of the support assembly 36 mounted on a base plate.

As best shown in FIG. 1, the balance beam 10 is comprised of a hollow elongated metal beam member 12 which has a top 14, bottom 16, opposite ends 18, and a center portion 20.

A leg 22 is mounted to each of the opposite ends 18 of beam member 12. Each leg has an upper end 24, a lower end 26, an upper portion 28, a lower portion 30 and a knee portion 32. As viewed in FIG. 1, it is seen that the upper portion 28 forms an obtuse angle with lower portion 30 at knee portion 32 of approximately 135°. A transverse horizontal floor engaging portion 34 is located at the lower end 26 of each leg 22. Member 34 extends transversely to the longitudinal axis of beam member 12.

A support assembly 36 is shown in dotted lines in FIG. 1 and is shown in more detail in FIG. 3. The assembly 36 is mounted on base plate 38 which has a square or rectangular opening 40 therein. Apertures 41 are located in plate 38 to facilitate the mounting of the plate to the bottom of beam member 12 by means of bolts or the like.

A block 42 and a block 44 are rigidly secured to plate 38 in any convenient manner and are positioned in parallel spaced relationship to each other. Two ¾ inch diameter ground and polished steel shafts 46 extend in parallel spaced relationship with respect to the blocks 42 and 44. An intermediate block 48 is slidably mounted on shafts 46 and has a clevis 50 with aperture 51 therein which extends downwardly through opening 40. Linear bearings 52 surround shafts 46 and are mounted in suitable apertures 53 in intermediate block 48 to facilitate the sliding action of the intermediate block 48 with respect to the shafts 46.

An elongated small diameter rod 54 has its ends mounted in blocks 42 and 44 and extends through an aperture 55 in intermediate block 48. A resilient element 56 is mounted on rod 54 between intermediate block 48 and block 44 which is nearest the center portion 20 of the beam member 12. The resilient element 56 is a urethane spring. Its resiliency is determined by its durometer value which preferably is in the range of 60–95 Shore A. Various springs 56 can be utilized to accommodate athletes of different weights.

An ear 58 is located on the upper ends 24 of each of the legs 22 and is connected to clevis 50 by pin 60 (FIG. 1).

A diagonally disposed link 62 is pivotally secured by its ends to tabs 64 and 66 which are secured to the lower bottom ends of beam member 12 and to the upper portion 28 of legs 22 (FIG. 1).

Figure 4:
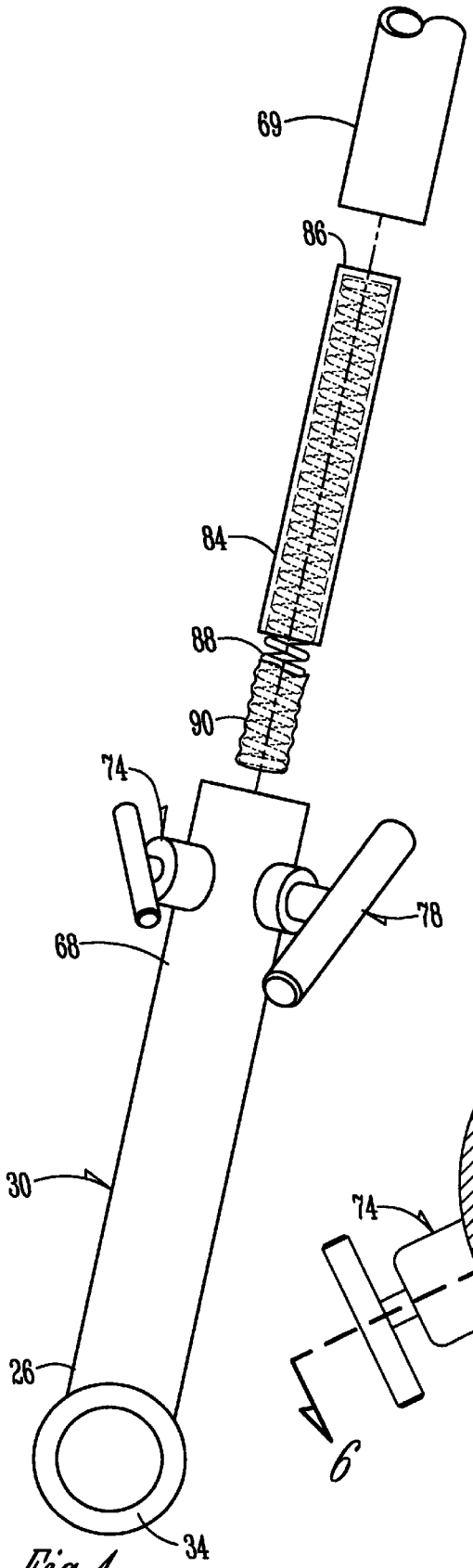
FIG. 4 is an exploded view of the lower portion of the leg construction.
Figure 5:
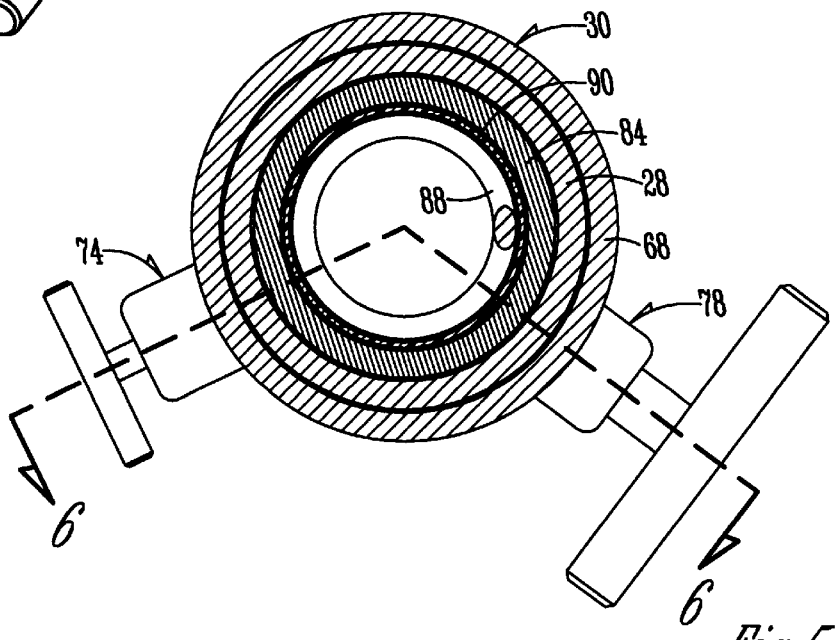
FIG. 5 is an enlarged scale sectional view taken on line 5—5 of FIG. 1.
Figure 6:
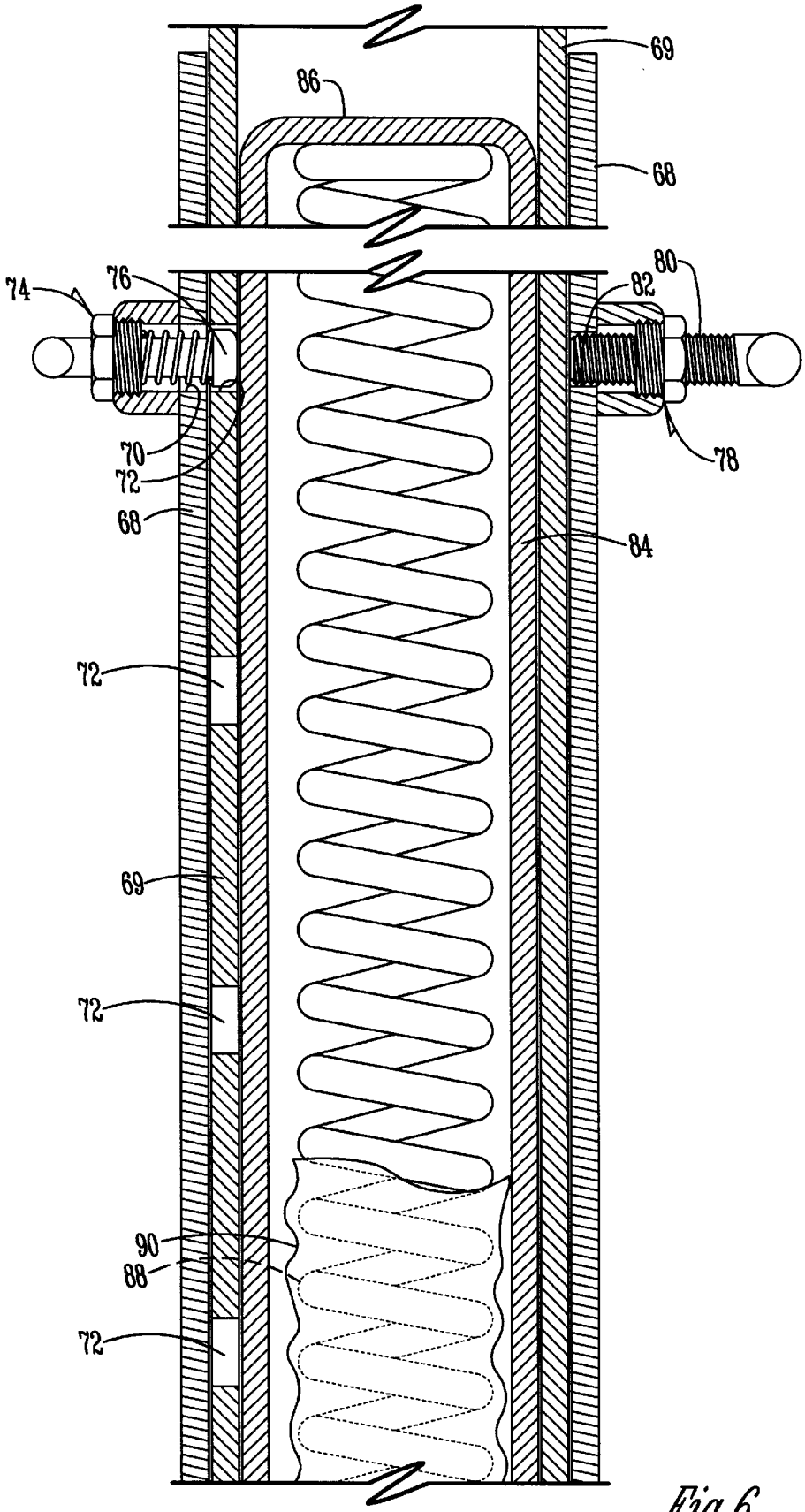
FIG. 6 is an enlarged scale sectional view taken on line 6—6 of FIG. 5.

With reference to FIGS. 4, 5 and 6, the lower portion 30 of leg 22 is comprised of hollow tube 68 which is rigidly secured to and extends upwardly from the transverse horizontal floor engaging portion 34 of the leg 22. Tube 68 extends upwardly around the portion 69 of the legs 22.

Aperture 70 is located in the leg 22 and are adapted to register with apertures 72 in tube 68. A snap lock 74 (FIG. 6) is mounted on the outside surface of the lower portion 30 of leg 22 and has a spring loaded plunger 76 which is adapted to penetrate registering apertures 70 and 72. A spin lock 78 is also mounted on the outer surface of lower portion 30 and has a threaded bolt 80 which is adapted to be threadably inserted through the aperture 82 of lower portion 30 of the leg. (FIG. 6). Both the snap lock 74 and the spin lock 78 are old in the gymnastics art as typically shown in U.S. Pat. No. 3,554,585.

A sleeve 84 is rigidly mounted within tube 69 and has a closed upper end 86. An elongated assist spring 88 is mounted within sleeve 84 and extends upwardly above the level of spin lock 78. The spring 88 is coated with rubber or plastic or the like to facilitate its handling. The spring 88 is under compression by reason of its bottom being in engagement with member 34 and its top end being in compression engagement with the closed upper end 86 of sleeve 84. With the spring in place as described, some of the weight of beam member 12 is always borne by the spring. Thus, when the legs 22 are subjected to height adjustment through the use of snap lock 74 and spin lock 78, it is not necessary that the operator hold up the entire end weight of beam 12 while the snap lock and the spin lock are being utilized. In operation, a resilient element 56 is selected to accommodate the weight of the gymnast using the balance beam 10. Further, there are sufficient apertures 72 in member 69 to accommodate height adjustments of 25 CMS between 100 CMS and 125 CMS. Between these two height adjustments, the member 34 only moves outwardly a distance of approximately 2 inches which means that a special floor mat does not have to be installed in order to accommodate the various height adjustments of the legs of the balance beam. There are sufficient apertures 72 to make height adjustments in increments of 5 CMS. Since the reflex action created by resilient element 56 is created by a horizontal movement of the intermediate block 48, the horizontal disposition of the beam stays constant at any height adjustment, and it does not get more resilient at lower elevations.

It is therefore seen that this invention will accomplish at least all of its stated objectives.

What is claimed is:

1. A balance beam, comprising, an elongated beam member having opposite ends, a center portion, a top and a bottom, legs on the bottom of said beam member adjacent the ends thereof, each leg having an upper end and a lower end, a pair of resilient support assemblies mounted within said elongated beam adjacent the ends thereof and each having a depending clevis extending downwardly therefrom with each clevis being pivotally secured to one of the upper ends of said legs, each of said support assemblies having two end blocks rigidly secured to said beam member, an intermediate block sidably mounted between said end blocks and associated with said clevis, and a resilient element being located between said intermediate block and the end block nearest the center portion of said beam member so that when a vertical force is applied downwardly on the top of said beam, said resilient element will yieldingly resist the sliding of said intermediate block towards said center portion, said legs extending downwardly and outwardly from said support assembly in a vertical plane of said beam member so that the lower ends of said legs dwell substantially under the ends of the beam member, and elongated links pivotally secured by their ends to one end of said beam and to one or each of said legs to hold said beam member in an erected elevated horizontal position.

2. The beam of claim 1 wherein each leg has an upper portion that extends downwardly and outwardly from the clevis, and a lower portion that extends downwardly and outwardly from said upper portion, with said upper and lower portions having center axes forming an obtuse angle with respect to each other.

3. The beam of claim 1 wherein said legs are length adjustable.

4. The beam of claim 1 wherein beam member is slightly resilient, and said support assembly has said resilient element which permits the upper ends of said legs to move resiliently horizontally towards said center portion when said beam member is loaded and deflected by the weight of a gymnast.

5. The beam of claim 1 wherein said endblocks are rigidly secured to a base plate which is rigidly secured to the bottom of said beam, with said plate having an opening therein through which said clevis extends.

6. The beam of claim 1 wherein the deflection of said beam in a downwardly direction caused by a person performing therefrom will cause the upper ends of said legs to move horizontally toward said center portion.

7. The beam of claim 1 wherein said legs are hollow, a floor engaging member has a rigid hollow tube slidable in said legs, registerable apertures in said legs and said hollow tube, a pin extending through a pair of registerable apertures to hold said legs in a selected elevation, and a releasable lock bolt extending through an aperture in said leg to bind said hollow tube within said leg.

8. The beam of claim 7 wherein a sleeve is located within said hollow tube to limit the degree of penetration of said pin through said pair of registering apertures.

9. The beam of claim 8 wherein an elongated coiled assist spring extends from the bottom of each spring to an upper closed end of said sleeve, said spring being in a compressed condition at all times to exert an upper force on said beam member through said leg member to facilitate the height adjustment of said leg when said pin is penetrating other pairs of registering apertures.

* * * * *

UNITED STATES PATENT AND TRADEMARK OFFICE

CERTIFICATE OF CORRECTION

PATENT NO. : 5,885,189

DATED : March 23, 1999

INVENTOR(S) : Mark R. Lane and Neal C. Squibb

It is certified that error appears in the above-identified patent and that said Letters Patent are hereby corrected as shown below:

In column 3, line 57 cancel - sidably - and insert "slidably".

In column 4, line 14, cancel - or - and insert "of".

Signed and Sealed this

Twenty-fourth Day of August, 1999

*Attest:*

Q. TODD DICKINSON

*Attesting Officer*

*Acting Commissioner of Patents and Trademarks*